US005622808A

United States Patent [19]

Bowman et al.

[11] Patent Number: 5,622,808

[45] Date of Patent: Apr. 22, 1997

[54] RECEIVER FOR DYE IMBIBITION PRINTING

[75] Inventors: Wayne A. Bowman, Walworth; Charles P. Hagmaier, Rochester; Frank D. Manioci, Henrietta, all of N.Y.

[73] Assignee: Eastman Kodak Company, Rochester, N.Y.

[21] Appl. No.: 614,413

[22] Filed: Mar. 12, 1996

[51] Int. Cl.[6] ..... G03C 8/26; G03C 7/25; G03C 7/24

[52] U.S. Cl. ..... 430/199; 430/213; 430/941; 430/628; 430/631; 430/140; 101/464

[58] Field of Search ..... 430/199, 140, 430/213, 631, 941, 628; 101/464; 503/227

[56] References Cited

U.S. PATENT DOCUMENTS

| | | | |
|---|---|---|---|
| 2,837,430 | 6/1958 | Goldberg et al. | 430/292 |
| 2,882,156 | 4/1959 | Minsk | 430/213 |
| 3,435,761 | 5/1966 | Weyerts | 101/464 |
| 3,625,694 | 12/1971 | Cohen et al. | 430/213 |
| 3,709,690 | 1/1973 | Cohen et al. | 430/213 |
| 3,898,088 | 8/1975 | Cohen et al. | 430/213 |
| 3,958,995 | 5/1976 | Campbell et al. | 430/213 |
| 5,135,835 | 8/1992 | Aono et al. | 430/203 |

*Primary Examiner*—Richard L. Schilling
*Attorney, Agent, or Firm*—Andrew J. Anderson

[57] ABSTRACT

Dye imbibition printing blanks are disclosed comprising a support bearing a layer comprising a cationic mordant, a hydrophilic colloid and a plasticizer polymer, wherein the plasticizer polymer is a latex polymer having a glass transition temperature below about 30° C. comprising from about 2 to 20 wt % of units having a quaternary ammonium group. In a preferred embodiment, the latex polymer comprises a vinyl co-polymer addition product of from about 50 to 98 weight percent of acrylic or methacrylic ester units, 0 to 48 weight percent of vinyl benzene units and 2 to 20 weight percent of the quaternary ammonium group containing unit. This latex provides a dye imbibition printing blank substantially free of haze and brittleness.

8 Claims, No Drawings

RECEIVER FOR DYE IMBIBITION PRINTING

FIELD OF THE INVENTION

This invention relates to a photographic imbibition dye transfer process and imbibition printing materials. It relates particularly to improved dye imbibition printing blanks.

BACKGROUND OF THE INVENTION

The imbibition printing dye transfer process is well known. According to common procedures, a tanned colloid relief image is formed by imagewise exposure of a suitable light sensitive layer on a support, differentially hardening the colloid layer in accordance with the imagewise exposure, and removing the colloid from the support in inverse proportion to the amount of imagewise light exposure. The differential colloid hardening and removal is conventionally performed with a pyrogallol hardening developer as described, e.g., in U.S. Pat. No. 2,837,430, the disclosure of which is hereby incorporated by reference. For full color prints, three separate relief images corresponding to the blue, green, and red color records of the image being reproduced may be formed in separate blue, green, and red light sensitive matrix films by three separate exposures though a color negative film. The resultant colloid relief images are then dyed with yellow, magenta and cyan dyes, and the dye images transferred to a imbibition printing blank receiver film. In this manner imbibition printed colored dye images may be obtained which faithfully reproduce a colored subject. Imbibition printing blanks comprise a dye receiving layer on a support. Where the resulting image is intended to be viewed by light projection, such as in a motion picture film, a transparent film support is generally used.

U.S. Pat. Nos. 3,625,694; 3,958,995; and 3,898,088 disclose cationic (basic) mordants which may be used in dye imbibition printing blanks. Such mordants are suitable for use with anionic (acid) printing dyes. When using blanks containing a dye receiving layer comprising a cationic mordant and a hydrophilic colloid such as gelatin as a binder, there is a tendency for the blank to be brittle resulting in cracking and degradation of the transferred dye image.

The necessity for maintaining flexibility in film is obvious in view of the handling to which it is subjected in manufacturing and use. For example, films are flexed and bent during use in cameras, printers, projectors, and processing equipment. The brittleness of film is affected by both temperature and relative humidity, the latter being generally of greater practical importance. Below approximately 25 percent relative humidity, a significant change in film brittleness may occur with only a small change in relative humidity. The failures in film as a result of lack of flexibility may be of different types, depending upon the nature of the stress.

It has been suggested to include plasticizers in imbibition printing blanks and photographic elements to reduce brittleness. U.S. Pat. Nos. 2,882,156 and 3,709,690 disclose blanks containing mordants and polymer latices as plasticizers. U.S. Pat. No. 5,135,835 relates to heat developable photographic elements which contain a mordant, oil droplets and a polymer latex having a glass transition temperature (Tg) of 40° C. or less for improving brittleness.

PROBLEMS TO BE SOLVED

Often when polymer latices are added to a mordant layer containing a cationic mordant the layer becomes hazy due to incompatibility between the latex and the mordant. It would be desirable to provide a polymeric plasticizer for use with cationic mordants which would not result in increased haze.

SUMMARY OF THE INVENTION

This invention provides an improved dye imbibition printing blank comprising a support bearing a layer comprising a cationic mordant, a hydrophilic colloid and a plasticizer polymer, wherein the plasticizer polymer is a latex polymer having a glass transition temperature below about 30° C. comprising from about 2 to 20 wt % of units having a quaternary ammonium group. In a preferred embodiment, the latex polymer comprises a vinyl co-polymer addition product of from about 50 to 98 weight percent of acrylic or methacrylic ester units, 0 to 48 weight percent of vinyl benzene units and 2 to 20 weight percent of the quaternary ammonium group containing unit. This latex provides a dye imbibition printing blank substantially free of haze and brittleness.

DESCRIPTION OF PREFERRED EMBODIMENTS

Typical dye imbibition printing blanks within the scope of this invention comprise a support bearing a dye receiving layer containing a cationic mordant, a hydrophilic colloid, and a plasticizer polymer.

Cationic mordants in accordance with the invention are preferably quaternary ammonium and phosphonium mordants of the type described in U.S. Pats. Nos. 3,898,088 and 3,958,995, the disclosures of which are hereby incorporated by reference. The cross-linked mordants of U.S. Pat. No. 3,958,995 are particularly preferred. Such mordants are generally of the formula:

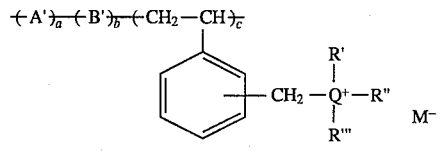

wherein A' represents units of an addition polymerizable monomer containing at least two ethylenically unsaturated groups; B' represents units of a copolymerizable α,β-ethylenically unsaturated monomer; Q is N or P; R', R", and R"' are independently carbocyclic or alkyl groups; $M^-$ is an anion; a is from about 0.25 to 10 mole percent, preferably from about 1 to 10 mole percent; b is from about 0 to 90 mole percent, preferably from about 0 to 60 mole percent; and c is from about 10 to 99 mole percent, preferably from about 40 to 99 mole percent, for effective dye mordanting.

It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents. Typical examples of photographic substituents include alkyl, aryl, anilino, carbonamido, sulfonamido, alkylthio, arylthio, alkenyl, cycloalkyl, and further to these exemplified are halogen, cycloalkenyl, alkinyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues. Usually the substituent will have less than 30 carbon atoms and typically less than 20 carbon atoms.

The hydrophilic colloid may be any of those generally employed in the photographic field, including, for example, gelatin, colloidal albumin, polysaccharides, cellulose derivatives, water-soluble polymer or copolymer including, but not limited to polyvinyl compounds, including polyvinyl alcohol and derivatives thereof, partially hydrolyzed poly-(vinylacetate-co-vinylalcohol), hydroxyethyl cellulose, poly(acrylic acid), poly(1-vinylpyrrolidone), poly(sodium styrene sulfonate), poly(2-acrylamido-2-methane sulfonic acid), polyacrylamides. Copolymers of these polymers with hydrophobic monomers may also be used. Gelatin is a preferred hydrophilic colloid. This may be gelatin per se or a modified gelatin such as acetylated gelatin, phthalated gelatin, oxidized gelatin, etc. Gelatin may be base-processed, such as lime-processed gelatin, or may be acid-processed, such as acid processed ossein gelatin.

In a preferred embodiment of the invention, the dye-receiving layer of the elements of the invention are hardened with a cross-linking agent. Various types of hardeners are useful in conjunction with elements of the invention. In particular, bis(vinylsulfonyl) methane, bis(vinylsulfonyl) methyl ether, 1,2-bis(vinylsulfonyl-acetamido) ethane, 2,4-dichloro-6-hydroxy-s-triazine, triacryloyltriazine, and pyridinium, 1-(4-morpholinylcarbonyl)-4-(2-sulfoethyl)-, inner salt are particularly useful. Also useful are so-called fast acting hardeners as disclosed in U.S. Pat. Nos. 4,418,142; 4,618,573; 4,673,632; 4,863,841; 4,877,724; 5,009,990; 5,236,822.

The plasticizer latex polymer of the invention are preferably water insoluble vinyl co-polymers derived from any copolymerizable monomers, such as α,β-ethylenically unsaturated monomer (including two, three, or more repeating units) such as ethylene, propylene, 1-butene, isobutene, 2-methylpentene, 2-methylbutene, 1,1,4,4-tetramethylbutadiene, styrene, α-methylstyrene; monoethylenically unsaturated esters of aliphatic acids such as vinyl acetate, isopropenyl acetate, allyl acetate, etc.; esters of ethyleneically unsaturated mono- or dicarboxylic acids such as methyl methacrylate, ethyl acrylate, diethyl methylenemalonate, etc.; monoethylenically unsaturated compounds such as acrylonitrile, allyl cyanide, and dienes such as butadiene and isoprene. The particular monomer units and their proportions may be selected to achieve a desired glass transition temperature for the resulting polymer as is well known in the art. For effective plasticizing, and as a distinguishing factor from cationic dye mordants, the plasticizer polymers of the invention have a glass transition temperature of about 30° C. or lower, more preferably about 20° C. or lower.

The latex polymers comprise from about 2 to 20 wt %, more preferably 2 to 10 wt %, of units having a quaternary ammonium group. Such units are preferably acrylic or methacrylic esters or amides to which the quaternary ammonium group is appended. A preferred class of ethylenically unsaturated monomers which may be used to form the remaining 80 to 98 wt % portion of the preferred vinyl polymers of this invention includes acrylic or methacrylic esters and vinyl benzenes.

In preferred embodiments of the invention, the units of the plasticizer latex polymer having a quaternary ammonium group are as defined in Formula I below, and in particularly preferred embodiments of the invention the plasticizer latex is of the Formula I.

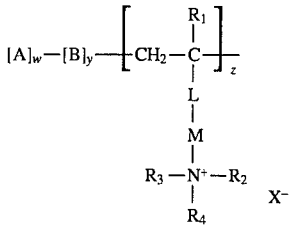

Formula I wherein A represents units derived from an acrylic or methacrylic ester monomer; B represents units derived from a vinyl benzene monomer; $R_1$ is H or methyl; L is —C(O)O—, —C(O)NH—, or an aromatic linking group such as phenyl; M is a $C_1$ to $C_{12}$ alkenyl linking group, which may be straight, branched, or cyclic; $R_2$, $R_3$, and $R_4$ are $C_1$ to $C_6$ alkyl groups; $X^-$ is an anionic counterion such as $CH_3SO_4^-$, $Cl^-$, $Br^-$, or $I^-$; w is 50 to 98 weight percent; y is 0 to 48 weight percent; and z is 2 to 20 weight percent.

Representative plasticizer polymers in accordance with the invention include the following:

| | |
|---|---|
| PP-1 | poly(ethylacrylate-co-styrene-co-2-(N,N,N-trimethylammonium)ethyl methacrylate methosulfate) 71/19/10 wt |
| PP-2 | poly(ethylacrylate-co-2-(N,N,N-trimethylammonium)ethyl methacrylate methosulfate) 90/10 |
| PP-3 | poly(butyl acrylate-co-styrene-co-2-(N,N,N-trimethylammonium)ethyl methacrylate methosulfate) 71/19/10 wt |
| PP-4 | poly(methyl acrylate-co-2-(N,N,N-trimethylammonium)ethyl methacrylate methosulfate) 95/5 wt |
| PP-5 | poly(ethyl acrylate-co-styrene-co-2-(N,N,N-trimethylammonium)ethyl methacrylate methosulfate) 75/20/5 wt |
| PP-6 | poly(butyl acrylate-co-3-(N,N,N-trimethylammonium)propyl methacrylamide methosulfate) 90/10 wt |
| PP-7 | poly(butyl acrylate-co-4-vinyl-N-methylpyridinium methylsulfate) 90/10 wt |
| PP-8 | poly(butyl acrylate-co-p-N-(vinylbenzyl)-N,N,N-trimethylammonium chloride) 90/10 wt |

The plasticizer polymers of the invention may be synthesized as set forth in the representative synthesis example described below or by using other well known vinyl polymer synthesis procedures.

The plasticizer polymer of this invention must contain a quaternary ammonium group to give acceptable haze and coating solution stability. Plasticizer latices which contain anionic groups cannot be coated because the mordant layer coating composition coagulates upon the addition of latices containing an anionic group.

The imbibition printing blanks of the invention may contain further features and layers as are known in the art. Preferred supports comprise transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate).

The elements of the invention may also include antistatic backing layers. Specifically contemplated is use of antistatic layer materials of the type used in photographic elements. In a preferred embodiment, the imbibition printing blanks of the invention include an antistatic backing layer as disclosed in co-pending, concurrently filed, commonly assigned U.S. Ser. No. 60/000,367 filed Jun. 20, 1995, now U.S. Ser. No. 08/614,423 filed Mar. 12, 1996 (Kodak Docket No. 71845AJA), the disclosure of which is incorporated herein by reference. As disclosed therein, any antistatic materials, excluding cationic polymers, such as those previously suggested for use with photographic elements may be used in the printing element antistatic layer in accordance with the invention. Such materials include, e.g., anionic polymers, electronic conducting non-ionic polymers, and metal halides or metal oxides in polymer binders.

Conductive fine particles of crystalline metal oxides dispersed with a polymeric binder have been used to prepare optically transparent, humidity insensitive, antistatic layers for various imaging applications. Many different metal oxides, such as AnO, $TiO_2$, $ZrO_2$, $Al_2O_3$, $SiO_2$, MgO, BaO, $MoO_3$, and $V_2O_5$, are disclosed as useful as antistatic agents in photographic elements or as conductive agents in electrostatographic elements in such patents as U.S. Pat. Nos. 4,275,103; 4,394,441; 4,416,963; 4,418,141; 4,431,764; 4,495,276; 4,571,361; 4,999,276; and 5,122,445, the disclosures of which are hereby incorporated by reference. Preferred metal oxides are antimony doped tin oxide, aluminum doped zinc oxide, and niobium doped titanium oxide, as these oxides have been found to provide acceptable performance characteristics in demanding environments. Particular preferred metal oxides for use in this invention are antimony-doped tin oxide and vanadium pentoxide which provide good resistance to static discharge and no dye stain resulting from transfer of dye from front side to the back of the film.

If desired, the element can be used in conjunction with an applied magnetic layer as described in *Research Disclosure,* November 1992, Item 34390 published by Kenneth Mason Publications, Ltd., Dudley House, 12 North Street, Emsworth, Hampshire P010 7DQ, ENGLAND.

Photographic silver halide emulsion layers may also be included in the elements of the invention. In a motion picture film blank, such a layer may be included between the support and the dye receiving layer as is known in the art in order to enable recording a sound track for the film in accordance with conventional motion picture sound track recording, exposing, and processing procedures. Alternatively, a sound track may be printed on the blank receiver as part of the imbibition printing process.

In the following discussion of suitable materials for use in the emulsions and elements that can be used in conjunction with the element of the invention, reference will be made to *Research Disclosure,* September 1994, Item 36544, available as described above, which will be identified hereafter by the term *"Research Disclosure."* The contents of the *Research Disclosure,* including the patents and publications referenced therein, are incorporated herein by reference, and the Sections hereafter referred to are Sections of the *Research Disclosure*, Item 36544.

Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

Matrix films for use with the printing blanks of the invention in imbibition printing dye transfer processes typically comprise a support bearing a light sensitive layer containing a hydrophilic colloid (typically gelatin), visible light absorbing particles (typically carbon), a silver halide light sensitive emulsion, plus various photographic addenda to provide satisfactory stability, as well as coating aid necessary for suitable manufacture. Sensitizing dyes may be used in each of the blue, green and red matrix films to provide blue, green, and red light sensitivity for recording blue, green, and red color records. As described above, after imagewise exposure, the colloid layers of such matrix films are typically differentially hardened and removed with a pyrogallol hardening developer as described in U.S. Pat. No. 2,837,430. After formation of colloid relief images in blue, green and red matrix films, the matrix films are dyed with yellow, magenta and cyan dyes, and the dye images are transferred to the mordant-containing receiver film. Exemplary yellow, magenta and cyan dyes which may be used in the imbibition printing process include Y-1, Y-2, M-1, and C-1 illustrated below. Preferred imbibition printing matrix films and exposing processes are decribed in co-pending, concurrently filed, commonly assigned U.S. Ser. No. 60/000,356 filed Jun. 20, 1995, now U.S. Ser. No. 08/614,454 filed Mar. 12, 1996 (Kodak Docket No. 72471AJA), the disclosure of which is incorporated herein by reference.

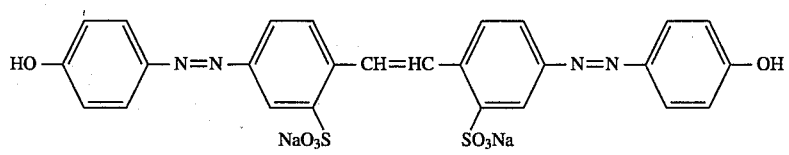

Y-1

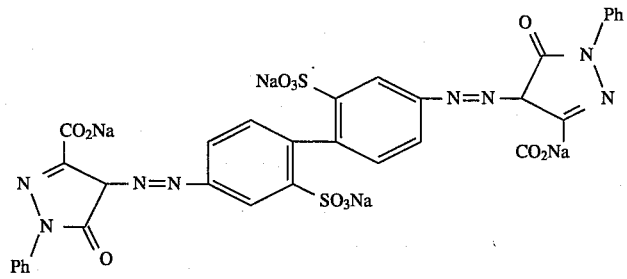

Y-2

-continued

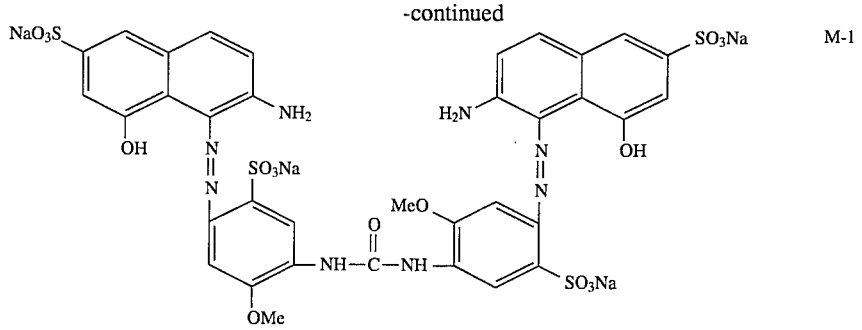

M-1

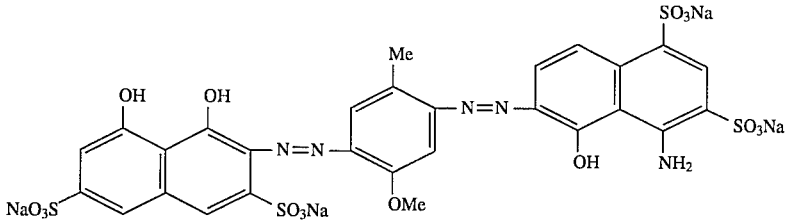

C-1

While the plasticizer polymers of the invention have been particularly described in connection with their use in a dye imbibition printing blank receiver, it will be understood that such plasticizers may also be used in other elements which employ a cationic mordant, such as photographic thermal dye transfer receiving layers or antihalation layers, where it is desired to use a plasticizer which does not generate haze in combination with such mordants. The plasticizers of the invention are most advantageous, however, in elements containing printed dye images which are viewed by light projection, such as motion picture films printed by dye imbibition, as it is most desirable to minimize haze in such embodiments.

Representative Synthesis Example

A latex copolymer having the composition 75 wt % ethylacrylate, 20 wt % styrene, and 5 wt % 2-(N,N,N-trimethylammonium) ethylmethacrylate methosulfate is prepared as follows: to a 500 ml addition flask was added 100 ml of distilled degased water, 1 ml of Igepal CO 730, 1 ml Ethoquad 0/12, 75 g of ethyl acrylate, 20 g of styrene, 6.3 g of 80% aqueous solution of 2-(N,N,N-trimethylammonium)ethyl methacrylate, and 0.5 g of 2,2'-azobis(2-methylpropionamidine)dihydrochloride. The mixture was stirred under nitrogen. To a 1 L reaction flask was added 300 ml of degased distilled water, 1 ml of Igepal CO 730, 1 ml of Ethoquad 0/12 and 0.5 g of 2,2'-azobis(2-methylpropionamidine)dihydrochloride. The reaction flask was placed in an 80° C. bath with stirring and the contents of the addition flask was added over a period of 30 minutes. The contents was stirred at 80 C. under nitrogen for 3 hours. The condenser was then removed and the flask was heated to 90 C. with a nitrogen purge for 1 hour to remove residual monomer. The flask was then cooled to give a translucent latex containing 24% solids.

EXAMPLE 1

Dye imbibition printing blanks were prepared as follows:

| Component | Coverage |
|---|---|
| Top layer: | |
| Mordant: copoly(N-vinylbenzyl-N,N,N-trimethylammoniumchloride co-ethyleneglycol dimethacrylate) 93/7 mole ratio | 861 mg/m$^2$ |
| Olin 10G surfactant | 97.3 mg/m$^2$ |
| $KNO_3$ antistatic agent | 39.7 mg/m$^2$ |
| gelatin | 2799 mg/m$^2$ |
| plasticizer polymer PP-1 | 280 mg/m$^2$ |
| Bottom layer: | |
| EDTA sodium salt | 83.2 mg/m$^2$ |
| Methylbenzothiazolium chloride | 10.1 mg/m$^2$ |
| Gelatin | 3498 mg/m$^2$ |
| Bisvinysulfonylmethyl ether | 75.6 mg/m$^2$ |
| Support: | |
| A 4.7 mil polyethylene terphthalate film support coated on the backside with a layer containing Elvanol 71-30 (polyvinylalcohol from DuPont) (54 mg/m$^2$), Volan (methacrylato chromic chloride from DuPont) (1.9 mg/m$^2$) and potassium nitrate (5.4 mg/m$^2$). | |

Additional blanks were prepared substituting plasticizer polymers PP-2, PP-3 and PP-4 of the invention and comparative plasticizer polymers C-1, C-2 and C-3 for PP-1 at equal weights.

| | |
|---|---|
| C-1 | poly(methyl acrylate) |
| C-2 | poly(ethyl acrylate) |
| C-3 | poly(ethyl acrylate-co-styrene) 80/20 wt |

The haze of each coating was measured after drying using a XL-211 Hazegard system manufactured by BYK-gardner which measures the transmitted light passed through a sample. The results are presented in Table 1 below:

TABLE 1

| Plasticizer Polymer | % Haze |
|---|---|
| None | 1.5 |
| PP-1 | 1.4 |
| PP-2 | 1.4 |
| PP-3 | 1.4 |
| PP-4 | 1.2 |
| C-1 | 7.5 |
| C-2 | 2.9 |
| C-3 | 4.1 |

As demonstrated above, plasticizer polymers other than those of the invention in the presence of the mordant in the coating composition can cause hazy coatings to occur upon drying. This difficulty is overcome by using the plasticizer latex of this invention.

EXAMPLE 2

The effectiveness of plasticizer latex in accordance with the invention at reducing brittleness was also demonstrated. A dye imbibition printing blank was made as described in Example 1, with PP-5 in place of PP-1 at the indicated coverages. The brittleness test performed provides for quantitatively measuring the brittleness of film by subjecting it to bending. By means of a wedge, the diameter of a film loop was constantly changed through gradually decreasing openings until a failure of the film resulted. The opening of the wedge at which the film failed is the measure of its brittleness. The film was conditioned at 15 percent relative humidity and 21° C. before running the test. The smaller wedge opening before the onset of failure the more flexible the film.

TABLE 3

| Example | Polymer level mg/m$^2$ | Brittleness (relative wedge opening at failure) |
|---|---|---|
| 2.1 (comparison) | 0 | 0.20 |
| 2.2 (invention) | 215 | 0.11 |
| 2.3 (invention) | 430 | 0.08 |

Table 3 shows the effectiveness of the plasticizer latex of the invention to give acceptable coatings with reduced brittleness.

The invention has been described in detail with particular reference to preferred embodiments thereof, but it will be understood that variations and modifications can be effected within the spirit and scope of the invention.

What is claimed is:

1. In a dye imbibition printing blank comprising a support bearing a dye-receiving layer comprising a cationic mordant, a hydrophillic colloid, and a plasticizer polymer, the improvement wherein the plasticizer polymer is a latex polymer having a glass transition temperature below 30° C. comprising from about 2 to 20 wt % of units having a quaternary ammonium group.

2. The printing blank according to claim 1, wherein the plasticizer polymer is a vinyl co-polymer and wherein the units having a quaternary ammonium group are acrylic or methacrylic esters or amides to which the quaternary ammonium group is appended.

3. The printing blank according to claim 2, wherein the plasticizer polymer is of the formula

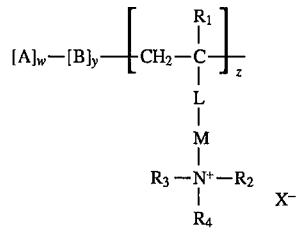

wherein A represents units derived from an acrylic or methacrylic ester monomer; B represents units derived from a vinyl benzene monomer; $R_1$ is H or methyl; L is —C(O)O—, —C(O)NH—, or an aromatic linking group; M is a $C_1$ to $C_{12}$ alkenyl linking group; $R_2$, $R_3$, and $R_4$ are $C_1$ to $C_6$ alkyl groups; $X^-$ is an anionic counterion; w is 50 to 98 weight percent; y is 0 to 48 weight percent; and z is 2 to 20 weight percent.

4. The printing blank according to claim 2, wherein X is $CH_3SO_4^-$, $Cl^-$, $Br^-$, or $I^-$.

5. The printing blank according to claim 1, wherein the hydrophillic colloid is gelatin.

6. The printing blank according to claim 1, wherein the cationic mordant is of the formula

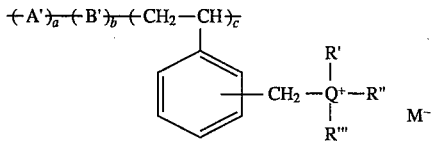

wherein A' represents units of an addition polymerizable monomer containing at least two ethylenically unsaturated groups; B' represents units of a copolymerizable α,β-ethylenically unsaturated monomer; Q is N or P; R', R", and R"' are independently carbocyclic or alkyl groups; $M^-$ is an anion; a is from about 0.25 to 10 mole percent; b is from about 0 to 60 mole percent; and c is from about 40 to 99 mole percent.

7. The printing blank according to claim 1, wherein the support is transparent.

8. The printing blank according to claim 1, further comprising a silver halide emulsion layer for recording a sound track.

* * * * *

UNITED STATES PATENT AND TRADEMARK OFFICE

CERTIFICATE OF CORRECTION

PATENT NO. : 5,622,808
DATED : April 22, 1997
INVENTOR(S) : Wayne A. Bowman, Charles P. Hagmaier, and Frank D. Manioci It is certified that error appears in the above-identified patent and that said Letters Patent is hereby corrected as shown below:

| | |
|---|---|
| Title Page | After item [22], insert --Related U.S. Application Data [60] Provisional Application Serial No. 60/000,355, filed June 20, 1995.-- |
| Column 1, line 3 | insert --CROSS REFERENCE TO RELATED APPLICATION<br>Reference is made to and priority claimed from U.S. Provisional Application Serial No. US 60/000,355, filed June 20, 1995, entitled RECEIVER FOR DYE IMBIBITION PRINTING.-- |

Signed and Sealed this

Twenty-third Day of December, 1997

Bruce Lehman

*Attest:*

BRUCE LEHMAN

*Attesting Officer*

*Commissioner of Patents and Trademarks*